US012753935B2

(12) United States Patent
Wang et al.

(10) Patent No.: US 12,753,935 B2
(45) Date of Patent: Oct. 6, 2026

(54) AIR GUIDE RING, AIR CONDITIONER OUTDOOR UNIT, AND AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Mingren Wang, Foshan (CN); Dongdong Yu, Foshan (CN); Shengsheng Liao, Foshan (CN); Langshui Huang, Foshan (CN); Ruhui Li, Foshan (CN); Weihong Luo, Foshan (CN); Tao Zhang, Foshan (CN); Lihe Chen, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 305 days.

(21) Appl. No.: 18/518,685

(22) Filed: Nov. 24, 2023

(65) Prior Publication Data

US 2024/0085035 A1 Mar. 14, 2024

Related U.S. Application Data

(63) Continuation of application No. PCT/CN2022/107958, filed on Jul. 26, 2022.

(30) Foreign Application Priority Data

Aug. 26, 2021 (CN) ..... 202121834022.X

(51) Int. Cl.
*F24F 1/38* (2011.01)

(52) U.S. Cl.
CPC ..... *F24F 1/38* (2013.01)

(58) Field of Classification Search
CPC ..... F24F 1/38; F24F 1/50; F24F 1/0029
(Continued)

(56) References Cited

U.S. PATENT DOCUMENTS

2009/0108717 A1* 4/2009 Jang ..... F24F 1/50 312/100
2016/0187005 A1* 6/2016 Kwon ..... F24F 1/40 62/259.1

FOREIGN PATENT DOCUMENTS

CN 202792412 U 3/2013
CN 109340931 A 2/2019
(Continued)

OTHER PUBLICATIONS

Extended European Search Report dated Nov. 11, 2024 for European Patent Application No. 22851971.6.
(Continued)

*Primary Examiner* — Vivek K Shirsat
(74) *Attorney, Agent, or Firm* — Scully, Scott, Murphy & Presser, P.C.

(57) ABSTRACT

An air guide ring for an air conditioner outdoor unit is provided. The air guide ring includes an air guide ring body. An air guide channel is defined in the air guide ring body. The air guide ring body includes a first limiting portion and a second limiting portion. The first limiting portion and the second limiting portion are configured to fit with a fixing member of the air conditioner outdoor unit and to implement bi-directional limiting, so as to prevent inward contraction deformation and outward expansion deformation of the air guide ring body from occurring.

17 Claims, 13 Drawing Sheets

(58) Field of Classification Search
USPC ..... 454/339; 62/259.1; 321/100
See application file for complete search history.

(56) References Cited

FOREIGN PATENT DOCUMENTS

| | | | |
|---|---|---|---|
| CN | 215675544 | U | 1/2022 |
| EP | 3252386 | B1 | 9/2020 |
| EP | 3705796 | A1 | 9/2020 |
| KR | 101473875 | B1 | 12/2014 |
| WO | 2019159668 | A1 | 8/2019 |

OTHER PUBLICATIONS

International Search Report dated Sep. 21, 2022 issued in PCT/CN2022/107958.

* cited by examiner

AIR GUIDE RING, AIR CONDITIONER OUTDOOR UNIT, AND AIR CONDITIONER

CROSS-REFERENCE TO RELATED APPLICATIONS

The present application is a continuation application of International Application No. PCT/CN2022/107958 filed on Jul. 26, 2022, which claims priority to and benefits of Chinese Patent Application No. 202121834022.X filed on Aug. 6, 2021, the entire contents of each of which are incorporated herein by reference. No new matter has been introduced.

FIELD

The present application relates to but is not limited to the field of air conditioning devices, and in particular, relates to but is not limited to an air guide ring, an air conditioner outdoor unit and an air conditioner.

BACKGROUND

Air output amount of an air conditioner is a key index that affects performance of the air conditioner, and the air guide ring is a key component that affects the air output amount, which is mainly reflected in two aspects: a structure of the air guide ring itself and its cooperation with fan blades of the air conditioner. There is an optimal value of an installation gap between the air guide ring and the fan blades. If the gap is overly small, the air guide ring and the fan blades are prone to contacting with each other, which causes friction and even damages the fan blades. If the gap is overly large, the air output amount will be reduced.

SUMMARY

The following is a summary of subject matters described in detail herein. This summary is not intended to limit a protection scope of claims.

According to an embodiment, an air guide ring for an air conditioner outdoor unit is provided. The air guide ring includes an air guide ring body, in which an air guide channel is defined. The air guide ring body is provided with a first limit part and a second limit part. The first limit part and the second limit part are provided to be fitted with a fixing member of the air conditioner outdoor unit for implementing bidirectional limiting, so as to prevent inward contracting deformation and outward expanding deformation of the air guide ring body.

According to an embodiment, an air conditioner outdoor unit is provided. The air conditioner outdoor unit includes a fixing member and the air guide ring described above. The fixing member is provided with a first limit fitting part and a second limit fitting part. The first limit fitting part is fitted with the first limit part of the air guide ring to obstruct the outward expanding deformation of the air guide ring body. The second limit fitting part is fitted with the second limit part of the air guide ring to obstruct the inward contracting deformation of the air guide ring body.

According to an embodiment, an air conditioner is provided. The air conditioner includes the above air conditioner outdoor unit.

According to an embodiment, an air guide ring includes an inlet section, a middle section and an outlet section arranged in sequence along a flowing direction of airflow. The inlet section includes a first sub-inlet section disposed close to an air inlet end of the air guide ring and a second sub-inlet section disposed close to the middle section. An inner wall surface of the first sub-inlet section is a concave surface recessing toward the outside of the air guide ring, and an inner wall surface of the second sub-inlet section is a convex surface protruding toward the inside of the air guide ring. Along the flowing direction of airflow, an included angle between a tangent plane of the inner wall surface of the first sub-inlet section and a first plane perpendicular to an axis of the air guide ring gradually decreases, and an included angle between a tangent plane of the inner wall surface of the second sub-inlet section and the first plane gradually increases.

According to an embodiment, an air conditioner outdoor unit includes the above air guide ring.

According to an embodiment, an air conditioner includes the above air conditioner outdoor unit.

Other aspects will become apparent after reading and understanding the drawings and detailed description.

BRIEF DESCRIPTION OF DRAWINGS

Accompanying drawings are used to provide a further understanding of technical solutions of the present application, and constitute a portion of the description, They are used together with embodiments of the present application to explain the technical solutions of the present application, and do not constitute a restriction on the technical solutions of the present application.

Figure 1:
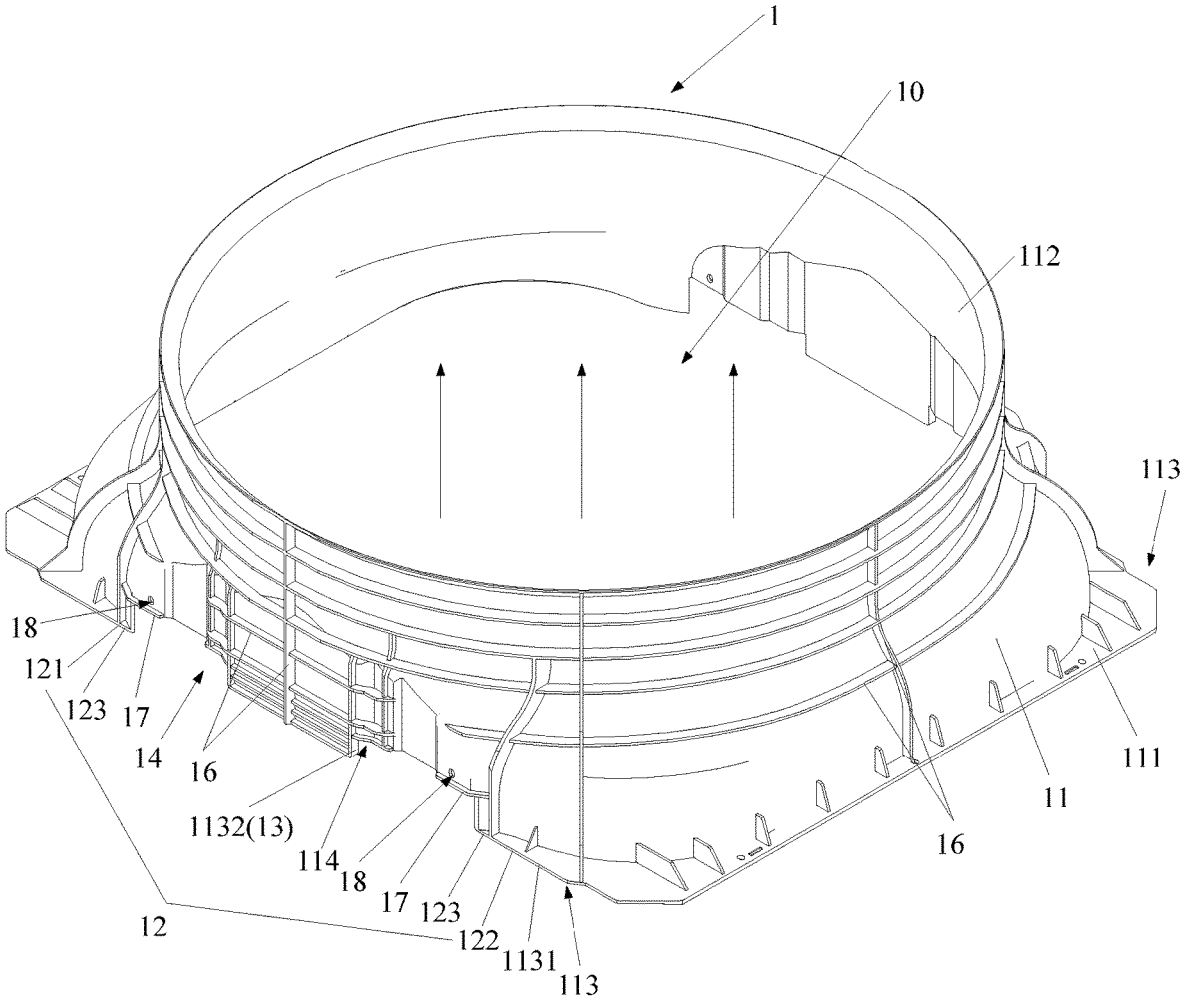
FIG. 1 is a schematic diagram of a structure of an air guide ring according to an embodiment of the present application.

In the drawings, components represented by reference signs are listed as follows:

1—air guide ring, 10—air guide channel, 11—air guide ring body, 111—connecting seat, 112—air guide tube, 113—limit sidewall, 1131—body portion, 1132—bulge part, 114—limit incision, 12—first limit part, 121—first sub-limit part, 122—second sub-limit part, 123—first limit surface, 13—second limit part, 131—second limit surface, 14—notch, 16—reinforcing rib, 17—support part, 18—screw fixing hole,

2—fixing member, 21—plate-shaped main body, 211—first limit fitting part, 212—second limit fitting part, 22—bending edge, 221—avoiding recess, 23—fixation lug;

100'—air guide ring, 101'—air inlet end, 102'—air outlet end, 1'—inlet section, 11'—first sub-inlet section, 12'—second sub-inlet section, 2'—middle section, 3'—outlet section.

DETAILED DESCRIPTION

A clear and complete description of technical solutions of embodiments of the present application will be made below with reference to the accompanying drawings in the embodiments of the present application. It is apparent that described embodiments are only part of the embodiments of the present application, not all of the embodiments of the present application. Based on the embodiments in the present application, all other embodiments obtained by those of ordinary skills in the art without paying creative efforts, fall within the scope of protection of the present application.

In addition, technical solutions among various embodiments of the present application may be combined with each other, but need to be on a basis that those of ordinary skills in the art can achieve them. When a combination of technical solutions conflicts or cannot be achieved, it should be considered that such combination of technical solutions does not exist and is not within the scope of protection claimed by the present application.

Figure 6:
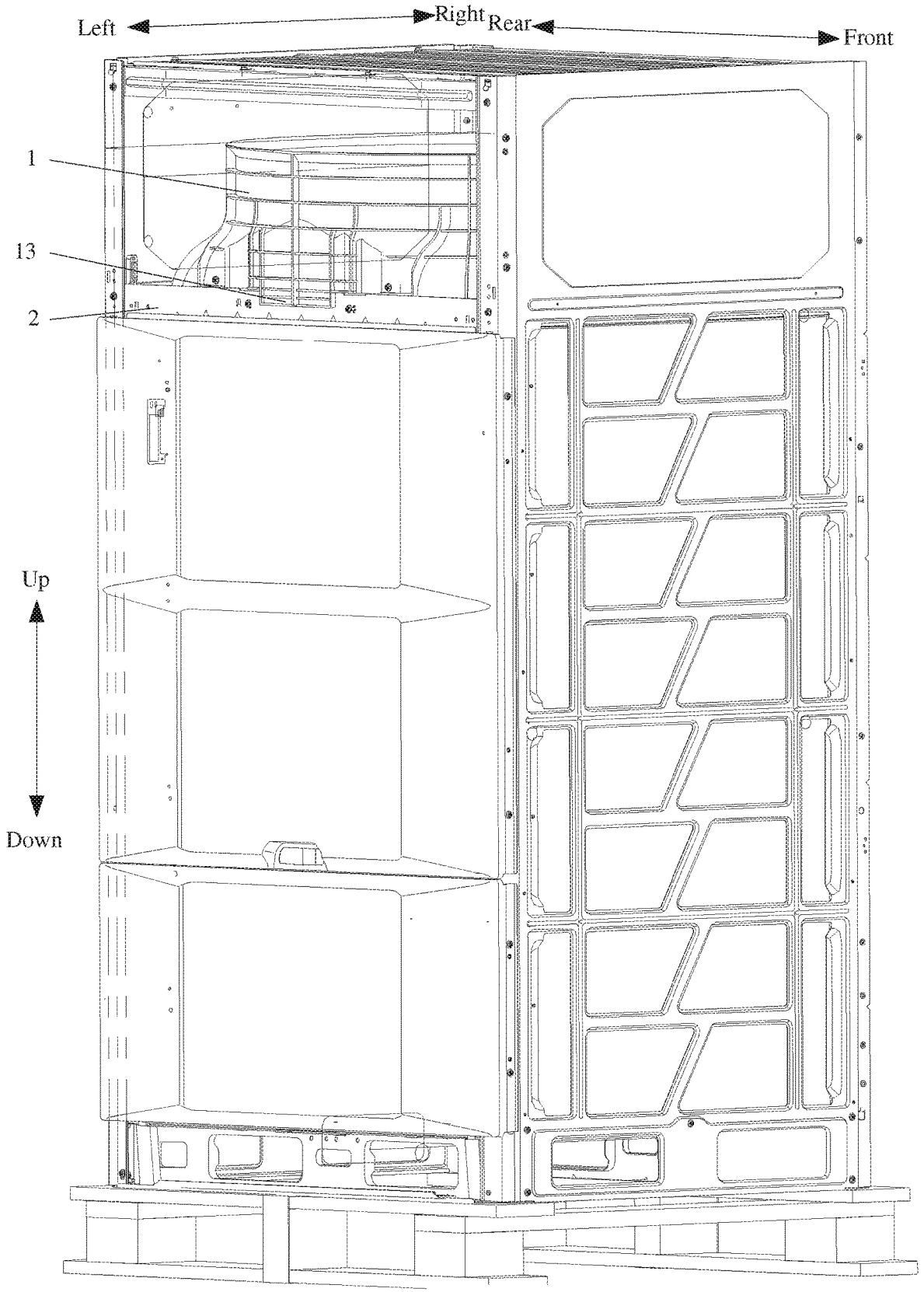
FIG. 6 is a schematic diagram of a structure of an air conditioner outdoor unit according to an embodiment of the present application.
Figure 7:
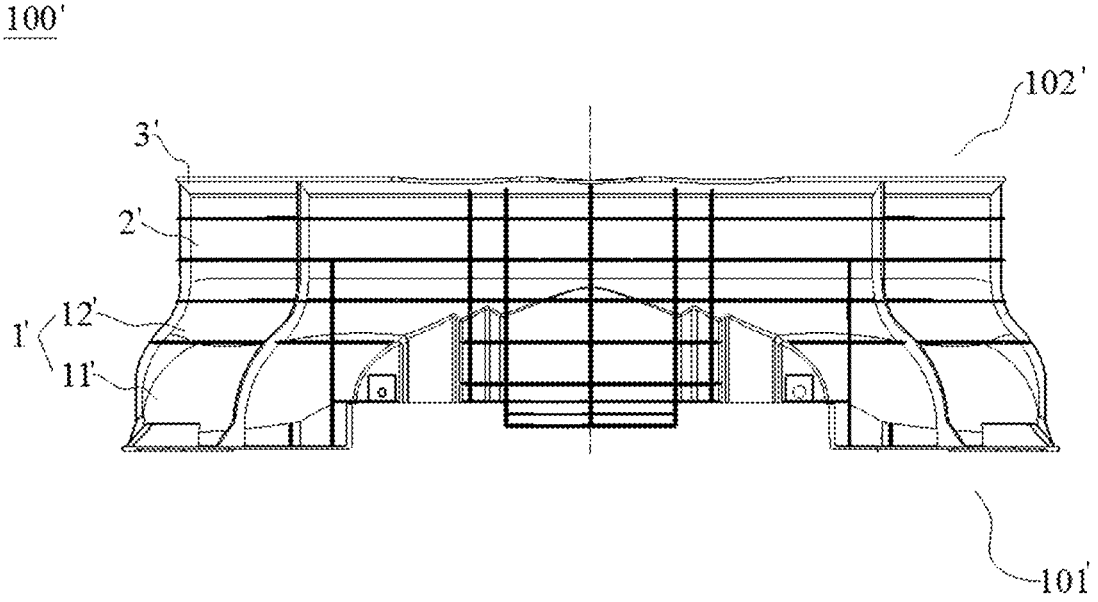
FIG. 7 is a schematic front view of a structure of an air guide ring according to an embodiment of the present application.
Figure 8:
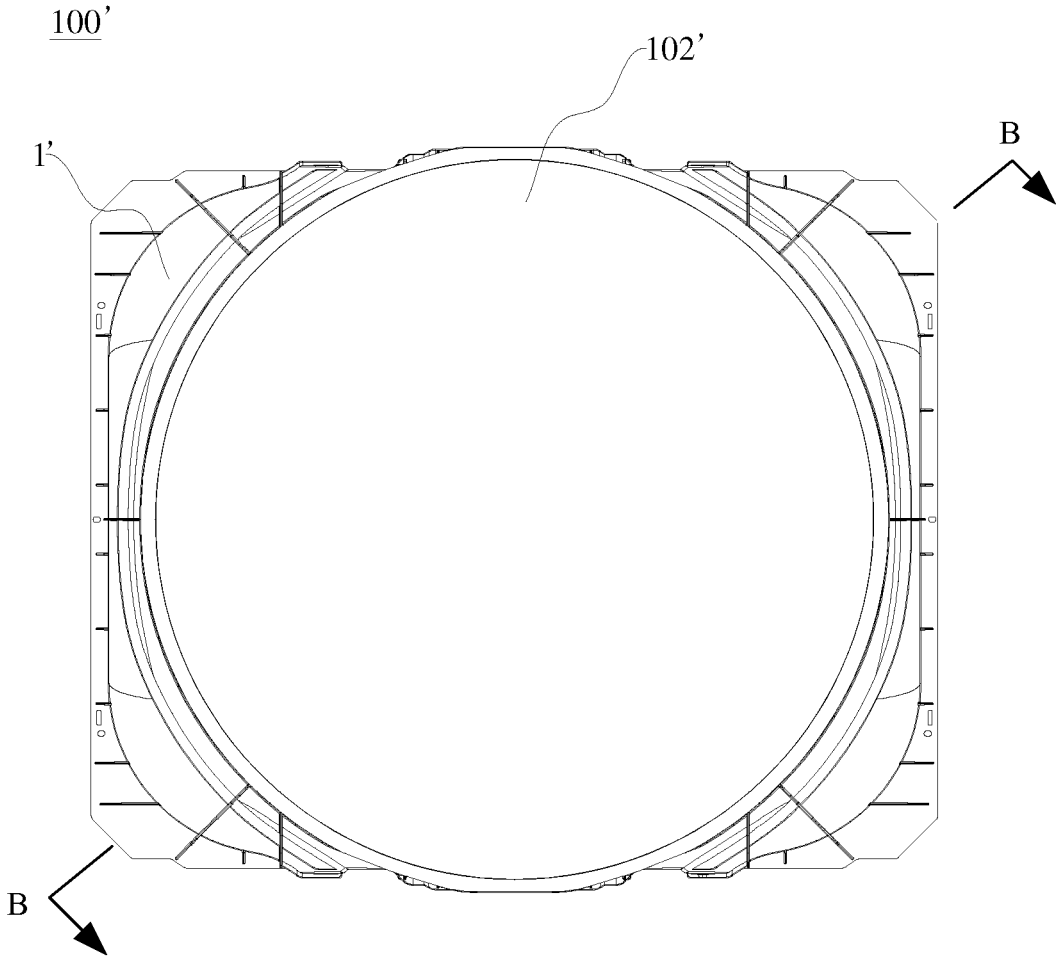
FIG. 8 is a schematic top view of a structure of an air guide ring according to an embodiment of the present application.
Figure 9:
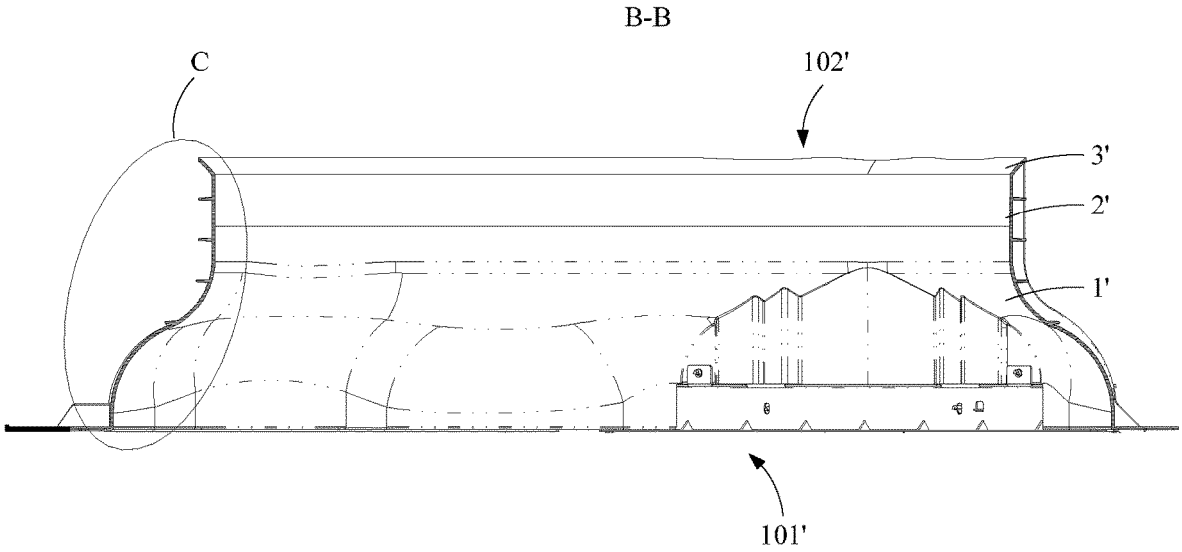
FIG. 9 is a schematic view of a sectional structure of FIG. 8 taken along B-B.

It should be noted that all directional indications (such as up, down, front, back, etc.) in the embodiments of the present application are only used to explain a relative positional relationship, a motion situation, etc., among various components under a specific posture (as shown in FIG. 6). If the specific posture changes, the directional indications will change accordingly.

During operation of an air conditioner, because of inevitable vibrations, fan blades and an air guide ring are obviously deformed after being stressed, and an installation gap cannot be maintained, while the installation gap is indispensable for maintaining a stable and efficient operation of the air conditioner.

Based on this, an embodiment of the present application provides an air guide ring, which can reduce a deformation amount of the air guide ring after being stressed, maintain the installation gap between the air guide ring and the fan blades, and improve performance of the air conditioner.

As shown in FIG. 1, an embodiment of the present application provides an air guide ring 1, which can be used for an air conditioner outdoor unit. The air guide ring 1 is provided to include an air guide ring body 11, and the integral air guide ring body 11 is annular. An air guide channel 10 is formed inside the air guide ring body 11, and the air guide channel 10 has an air inlet and an air outlet. The air guide ring 1 can be fitted with a fan, and fan blades of the fan can extend into the air guide channel 10 of the air guide ring 1, so that when the fan is working, airflow can enter from the air inlet, flow through the air guide channel 10, and finally be discharged from the air outlet. A flowing direction of the airflow is shown by the arrows in FIG. 1, with the air inlet of the air guide channel 10 on the lower side and the air outlet of the air guide channel 10 on the upper side.

As shown in FIGS. 1-4, the air guide ring body 11 is provided with two limit parts which are a first limit part 12 and a second limit part 13 respectively. Both the first limit part 12 and the second limit part 13 can be fitted with a fixing member 2 for limiting. For example, the first limit part 12 can be fitted with the first limit fitting part 211 of the fixing member 2 of the air conditioner outdoor unit for limiting, so as to prevent radially outward expanding deformation of the air guide ring body 11. The second limit part 13 can be fitted with the second limit fitting part 212 of the fixing member 2 to prevent radially inward contracting deformation of the air guide ring body 11. That is, the two limit parts can be fitted to limit the air guide ring body 11 bidirectionally, which can limit the radially outward expanding deformation and the radially inward contracting deformation of the air guide ring body 11.

Since the air guide ring body 11 is integrally annular, when a portion of the air guide ring body 11 expands and deforms radially outward, other portions of the air guide ring body 11 will contract and deform radially inward; or when a portion of the air guide ring body 11 contracts and deforms radially inward, other portions of the air guide ring body 11 will expand and deform radially outward. The first limit part 12 and the second limit part 13 limit the contraction and expanding deformation of the air guide ring body 11, which facilitates reducing the deformation amount of the air guide ring 1 after being stressed and maintaining shape stability of the air guide ring body 11, so as to maintain the installation gap between the air guide ring 1 and the fan blades during the operation of the air conditioner, thus avoiding mutual contact between the air guide ring 1 and the fan blades and even the damage of the fan blades caused by a too small gap and reduction in air output amount caused by a too large gap, and improving the performance of the air conditioner.

As a comparison, a common air guide ring is easy to deform during installation, which affects the fitting between an air wheel and the air guide ring, causing leakage loss at the tips of air wheel blades to increase, resulting in deterioration of performance of the fan system. For the air guide ring 1 according to the embodiment of the present application, by providing the first limit part 12 and the second limit part 13, the deformation of the air guide ring 1 is avoided, the fitting between the air wheel and the air guide ring 1 is ensured, the leakage loss at the tips of the air wheel blades is reduced, the performance of the fan system is ensured, thereby avoiding failure of the fan system.

In some exemplary embodiments, as shown in FIGS. 1-4, the second limit part 13 is disposed radially outward of the first limit part 12 (i.e., away from a center of the air guide ring body 11), and a radial interval is provided between the second limit part 13 and the first limit part 12. The second limit part 13 and the first limit part 12 can be clamped on two sides of the fixing member 2.

An outside wall surface of the first limit part 12 (i.e., a side wall surface on a side away from the center of the air guide ring body 11) may form a first limit surface 123, and an inside wall surface of the second limit part 13 (i.e., a side wall surface on a side close to the center of the air guide ring body 11) may form a second limit surface 131. The first limit surface 123 and the second limit surface 131 may be parallel to each other. The second limit surface 131 is located radially outward of the first limit surface 123, and a radial interval is provided between the first limit surface 123 and the second limit surface 131. After the fixing member 2 is inserted between the second limit part 13 and the first limit part 12, a first limit fitting part 211 of the fixing member 2 can abut against the first limit surface 123 for limiting, and a second limit fitting part 212 of the fixing member 2 can abut against the second limit surface 131 for limiting, so as to prevent radially outward expanding deformation and radially inward contracting deformation of the air guide ring body 11 and in turn reduce the deformation amount of the air guide ring 1 after being stressed.

In some exemplary embodiments, as shown in FIG. 1, the second limit part 13 and the first limit part 12 are provided to be offset along the air guide ring body 11 in a circumferential direction, that is, the second limit part 13 and the first limit part 12 are at different circumferential positions on the air guide ring body 11.

Apparently, the second limit part 13 and the first limit part 12 may also be provided to be distributed along the air guide ring body 11 in the circumferential direction, that is, the second limit part 13 and the first limit part 12 may be at a same circumferential position of the air guide ring body 11.

In some exemplary embodiments, as shown in FIG. 1, the two limit parts are provided to be offset along the air guide ring body 11 in the circumferential direction, and the first limit part 12 is provided to include two sub-limit parts, i.e., a first sub-limit part 121 and a second sub-limit part 122. The second limit part 13 is arranged between the two sub-limit parts, that is, the second sub-limit part 122, the second limit part 13 and the first sub-limit part 121 are arranged in sequence along the air guide ring body 11 in the circumferential direction.

After the fixing member 2 is inserted into the radial interval between the first limit part 12 and the second limit part 13, two ends of the first limit fitting part 211 of the fixing member 2 can respectively abut against the two sub-limit parts for limiting, and the second limit fitting part 212 of the fixing member 2 can abut against the second limit part 13 in the middle for limiting, which facilitates achieving the limit fitting between the air guide ring 1 and the fixing member 2.

In some exemplary embodiments, as shown in FIG. 1, a notch 14 is provided at one side of the air guide ring body 11, the notch 14 is at a side close to the air inlet, and the two sub-limit parts of the first limit part 12 are respectively on two sides of the notch 14. The air guide ring body 11 is provided with a bulge part 1132 extending along an axial direction toward the notch 14 (i.e., extending downward), and the bulge part 1132 can form the second limit part 13 such that the second limit part 13 is positioned between the second sub-limit part 122 and the first sub-limit part 121, thereby realizing the offset arrangement of the two limit parts.

In addition, the arrangement of the notch 14 is conducive to reducing a size of the air guide ring 1, so that the size of the air guide ring 1 can be maximized in the limited space in the air conditioner outdoor unit, thereby maximizing the size of the air wheel and improving the performance of the fan.

The bulge part 1132 may have a rectangular shape, a circular shape, etc. The bulge part 1132 and the first limit part 12 may form an embedded assembly structure. During the installation of the air guide ring 1, the fixing member 2 may extend between the bulge part 1132 and the first limit part 12, so as to effectively position the air guide ring 1 and prevent the air guide ring 1 from being out of position or deforming under stress.

In some exemplary embodiments, as shown in FIG. 1, a sidewall surface of the bulge part 1132 (second limit part 13) is provided with a reinforcing rib 16. The reinforcing rib 16 may be provided on an outside wall surface of the bulge part 1132 (i.e., a side wall surface at a side away from the center of the air guide ring body 11), or may be provided on an inside wall surface of the bulge part 1132 (i.e., a side wall surface at a side close to the center of the air guide ring body 11), or the reinforcing rib 16 may be provided on both the inside wall surface and the outside wall surface of the bulge part 1132. The reinforcing rib 16 is provided to extend along the axial direction of the air guide ring body 11 or along the circumferential direction of the air guide ring body 11. Alternatively, a plurality of reinforcing ribs 16 are provided, part of the reinforcing ribs 16 can extend along the axial direction of the air guide ring body 11, part of the reinforcing ribs 16 extend along the circumferential direction of the air guide ring body 11, and the reinforcing ribs 16 extending along the axial direction and the reinforcing ribs 16 extending along the circumferential direction cross each other in a grid shape.

The bulge part 1132 forming the second limit part 13 is provided with the reinforcing ribs 16 to enhance the strength of the bulge part 1132, thereby enhancing a limiting effect of the second limit part 13 and preventing the air guide ring 1 from being deformed under stress.

In some exemplary embodiments, a plurality of the first limit parts 12 are provided and are arranged along the air guide ring body 11 in the circumferential direction, such as uniformly arranged. A plurality of the second limit parts 13 are also provided and are arranged along the air guide ring body 11 in the circumferential direction, for example, the second limit parts 13 are uniformly arranged. The number of the second limit parts 13 and the number of the first limit parts 12 are equal, and they cooperate with each other in one-to-one correspondence.

The first limit part 12 and the corresponding second limit part 13 can cooperate with each other to implement the bidirectional limiting against the inward contracting deformation and the outward expanding deformation of the air guide ring body 11. The plurality of first limit parts 12 and the corresponding plurality of second limit parts 13 cooperate with each other to better limit the deformation of the air guide ring body 11.

Figure 4:
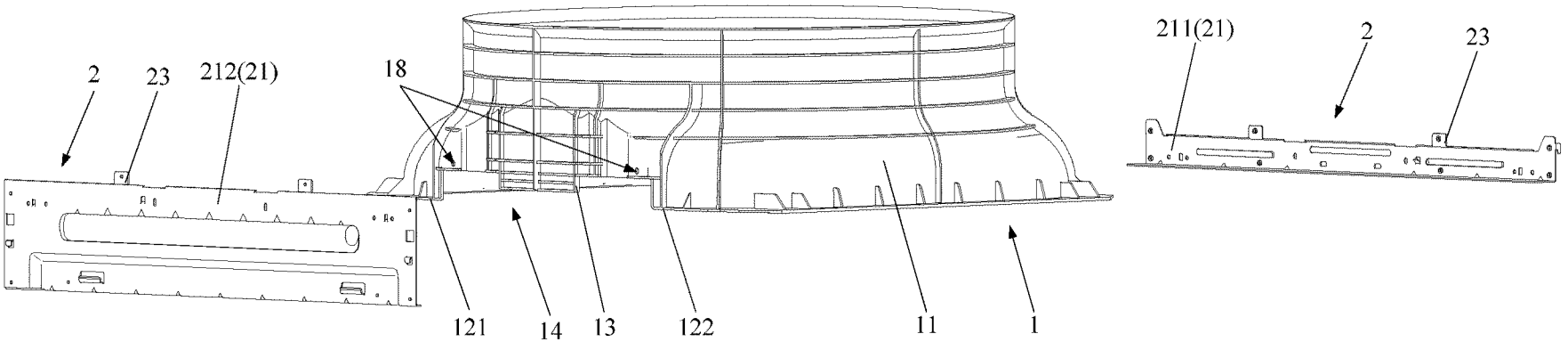
FIG. 4 is a schematic diagram of an exploded structure of the air guide ring and the fixing members shown in FIG. 2.
Figure 5:
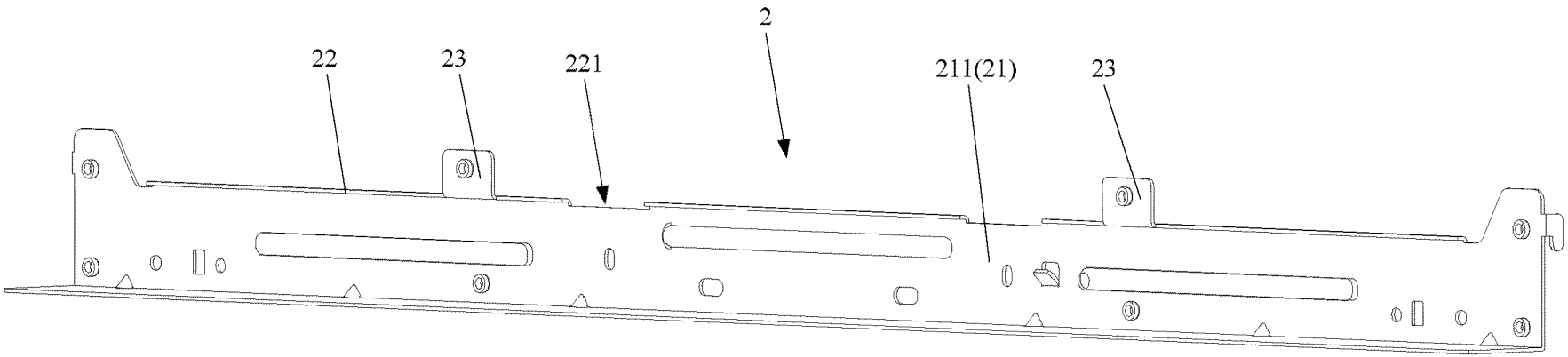
FIG. 5 is a schematic diagram of a structure of the fixing member of FIG. 2.

As can be seen from FIGS. 1 and 4, two second limit parts 13 and two first limit parts 12 are provided. One of the first limit parts 12 and a corresponding second limit part 13 are at a front side of the air guide ring body 11 and can be fitted with a fixing member 2 at the front side. The other of the first limit parts 12 and a corresponding second limit part 13 are at a rear side of the air guide ring body 11 and can be fitted with a fixing member 2 at the rear side. Alternatively, two first limit parts 12 may be provided at the left side and the right side of the air guide ring body 11, respectively, and two second limit parts 13 may be provided at the left side and the right side of the air guide ring body 11, respectively.

It should be understood that the number of the second limit parts 13 and the number of the first limit parts 12 provided are not limited to two and may be set as required.

Figure 2:
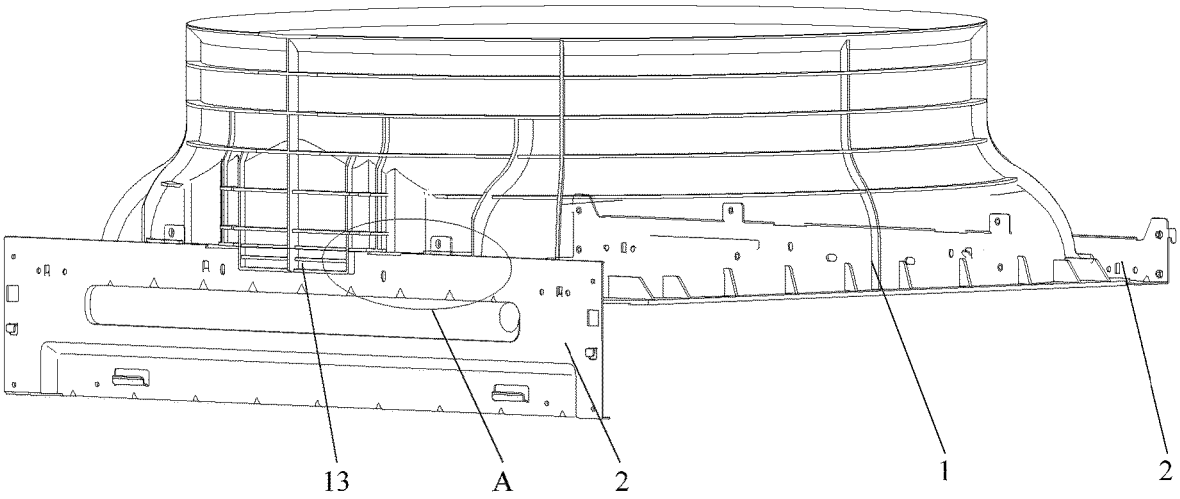
FIG. 2 is a schematic diagram of an assembly structure of the air guide ring shown in FIG. 1 and fixing members.
Figure 3:
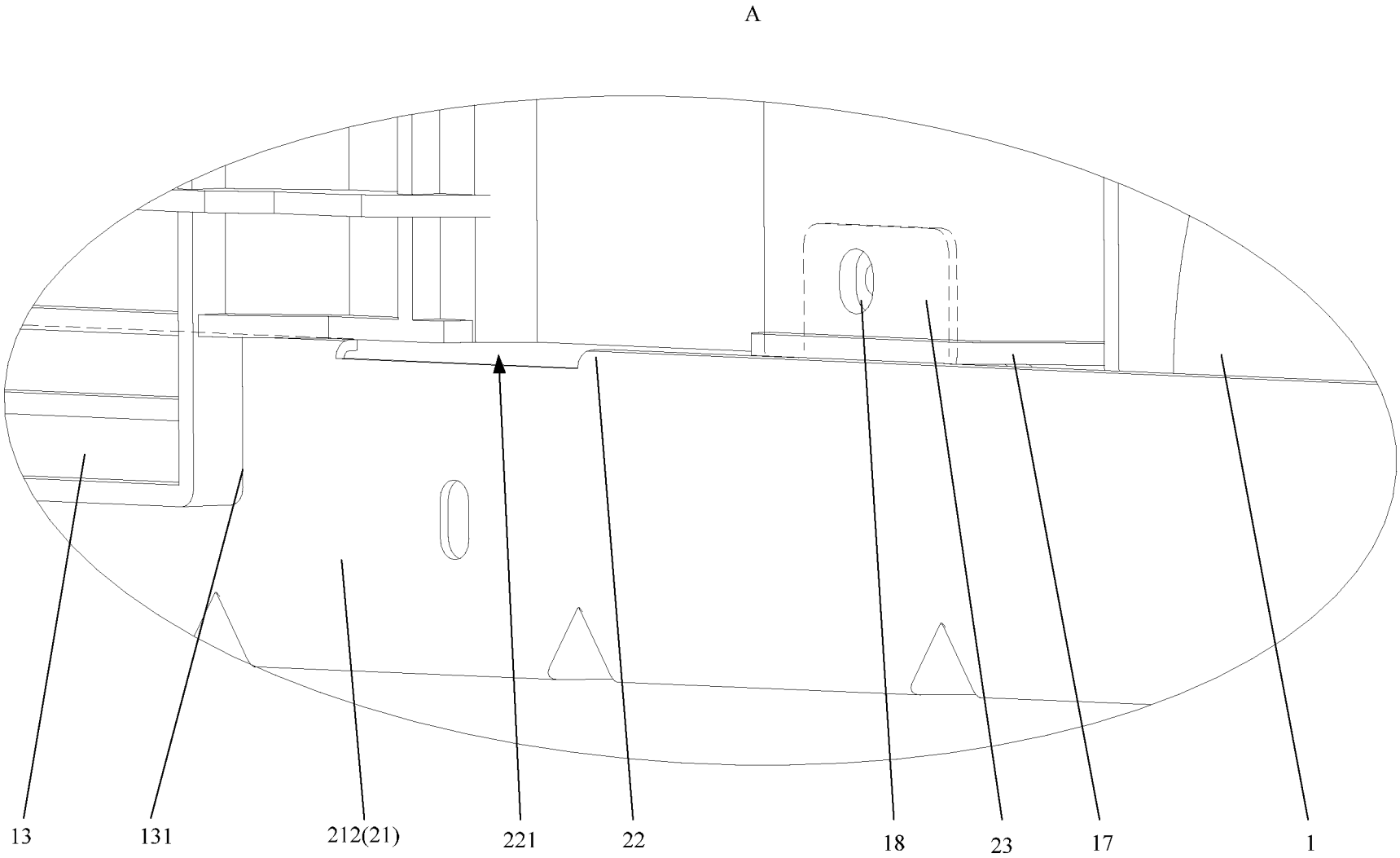
FIG. 3 is an enlarged schematic view of a structure of portion A in FIG. 2.

In some exemplary embodiments, as shown in FIGS. 1-3, the air guide ring body 11 is provided with support parts 17, and the support parts 17 are provided to extend along the air guide ring body 11 in the circumferential direction. The support parts 17 may be support ribs disposed on the outside wall surface of the air guide ring body 11. The support ribs may be provided as an integral structure, or the support parts 17 may include a plurality of support ribs arranged at intervals.

The support part 17 can be supported on the fixing member 2 to support and position the air guide ring 1 and the fixing member 2.

The second limit part 13 and the first limit part 12 are provided to be at a lower side of the support part 17 (i.e., at a side close to the air inlet of the air guide channel 10), so that the fixing member 2 is inserted between the first limit part 12 and the second limit part 13 from the side close to the air inlet until the fixing member 2 abuts against the support part 17, thus realizing the limit fitting and support fitting between the air guide ring body 11 and the fixing member 2.

In some exemplary embodiments, the side wall of the air guide ring body 11 is provided with a fixation part which can be fixedly connected with the fixing member 2. As shown in FIGS. 1-3, the fixation part may be a screw fixing hole 18, and the air guide ring body 11 and the fixing member 2 may be fixedly connected to each other by screws. A plurality (e.g. two) of screw fixing holes 18 may be provided to securely fix the air guide ring body 11 and the fixing member 2 by a plurality of screws.

As shown in FIGS. 2-4, the fixation part is disposed at an upper side of the support part 17 (i.e., at a side close to the air outlet of the air guide channel 10), and a fixation lug 23 may be disposed on an upper part of the fixing member 2, so that fixing is performed with a screw after a threaded hole on the fixation lug 23 coincides with a screw axis of the air guide ring body 11.

The air guide ring 1 and the fixing member 2 are axially supported and positioned by the support part 17, and are radially limited by the first limit part 12 and the second limit part 13 at the lower side, and are fixed by screws at the upper side, so that the fixation between the air guide ring 1 and the fixing member 2 is stable. Apparently, the positions of the second limit part 13 and the first limit part 12 are not limited to being at the lower side of the support part 17, and the position of the fixation part is not limited to being at the upper side of the support part 17, which can be adjusted as required.

In some exemplary embodiments, the air guide ring body 11 is provided with a limit protrusion that can be used for limiting in cooperation with a limit hole in the fixing member 2. Alternatively, the air guide ring body 11 is provided with a limit hole, and the limit hole can be fitted with the limit protrusion on the fixing member 2 for limiting.

The air guide ring body 11 and the fixing member 2 are respectively provided with a limit protrusion and a limit hole, so that the air guide ring body 11 and the fixing member 2 are limited through the fitting between the limit protrusion and the limit hole, so that the air guide ring body 11 and the fixing member 2 are fixed to each other.

In some exemplary embodiments, as shown in FIG. 1, the air guide ring body 11 is provided to include a connecting seat 111 and an air guide tube 112. The connecting seat 111 has a first air guide channel, the air guide tube 112 is provided in a hollow cylindrical shape, and the air guide tube 112 has a second air guide channel. The connecting seat 111 may be provided in a necking shape, and a first end of the connecting seat 111 (i.e., a necking end, the upper end in FIG. 1) is connected with the air guide tube 112. For example, the connecting seat 111 and the air guide tube 112 may be integrally formed such that the first air guide channel in the connecting seat 111 and the second air guide channel in the air guide tube 112 are connected to each other to form the air guide channel 10. The connecting seat 111 is disposed at a side close to the air inlet such that a second end of the connecting seat 111 (i.e., a flared end, the lower end in FIG. 1) forms the air inlet of the air guide channel 10, so that airflow enters the first air guide channel from the flared end and then flows out of the necking end and flows into the second air guide channel.

The connecting seat 111 can be fixedly fitted with the fixing member 2 to implement the fixation of the air guide ring 1.

In some exemplary embodiments, as shown in FIG. 1, the connecting seat 111 is provided to include two limit sidewalls 113 oppositely arranged, and each limit sidewall 113 is provided to include a first limit part 12 and a second limit part 13. The first limit part 12 and the second limit part 13 are disposed at intervals along the radial direction of the air guide ring body 11 and at least partially coincide along the axial direction of the air guide ring body 11, and the radial interval between the first limit part 12 and the second limit part 13 of each limit sidewall 113 is used to clamp a fixing member 2 so that the fixing member 2 is fitted with the first limit part 12 and the second limit part 13 for limiting to prevent radially outward expanding deformation and radially inward contracting deformation of the air guide ring body 11.

In some exemplary embodiments, as shown in FIG. 1, the limit sidewall 113 is provided to include a body portion 1131 and a bulge part 1132 protruding outwardly from the body portion 1131. The body portion 1131 of the limit sidewall 113 may form the first limit part 12, the bulge part 1132 may form the second limit part 13, and a limit incision 114 is formed between the body portion 1131 and the bulge part 1132. The limit incision 114 is used for clamping the fixing member 2.

Since the bulge part 1132 can protrude outward from the middle of the body portion 1131, the body portion 1131 at two ends of the limit sidewall 113 forms the first limit part 12, and the bulge part 1132 at the middle of the limit sidewall 113 forms the second limit part 13.

The first limit part 12 formed by the body portion 1131 of the limit sidewall 113 can be abutted against and fitted with the fixing member 2 to prevent the radially outward expanding deformation of the air guide ring body 11. The second limit part 13 formed by the bulge part 1132 can be abutted against and fitted with the fixing member 2 to prevent the radially inward contracting deformation of the air guide ring body 11.

As shown in FIG. 1, reinforcing ribs 16 extending along the axial direction and/or the circumferential direction of the air guide ring body 11 are provided on the outer wall surface of other portions of the air guide ring body 11 except for the bulge part 1132 (the second limit part 13), and the reinforcing ribs 16 extending along the axial direction and the reinforcing ribs 16 extending along the circumferential direction cross each other to form a grid shape. The reinforcing ribs 16 on the air guide ring body 11 can abut against the first limit fitting part 211 of the fixing member 2 for limiting, so as to further reduce the deformation amount of the air guide ring body 11.

As shown in FIG. 6, an embodiment of the present application further provides an air conditioner outdoor unit. The air conditioner outdoor unit is provided to include the air guide ring 1 of any of the above embodiments. The air conditioner outdoor unit can be a cabinet unit.

It should be understood that the air guide ring 1 according to the embodiment of the present application can also be applied to other products other than the air conditioner outdoor unit.

As shown in FIG. 1, the air conditioner outdoor unit is provided to further include a fixing member 2. As shown in FIGS. 2-5, the fixing member 2 is provided with the first limit fitting part 211, which can be fitted with the first limit part 12 of the air guide ring 1 for limiting, so as to prevent radially outward expanding deformation of the air guide ring body 11. The fixing member 2 is further provided with the second limit fitting part 212, which can be fitted with the second limit part 13 of the air guide ring 1 for limiting, so as to prevent radially inward contracting deformation of the air guide ring body 11.

Through the fitting between the first limit part 12 and the first limit fitting part 211, and the fitting between the second limit part 13 and the second limit fitting part 212, the deformation amount of the air guide ring 1 after being stressed can be reduced, so that the installation gap between the air guide ring 1 and the fan blades can be maintained during operation of the air conditioner, and the performance of the air conditioner can be improved.

In some exemplary embodiments, as shown in FIGS. 2-5, the fixing member 2 is provided to include a plate-shaped main body 21, and the plate-shaped main body 21 has two opposite plate surfaces to form the first limit fitting part 211 and the second limit fitting part 212, respectively. When the fixing member 2 is assembled with the air guide ring 1, the plate-shaped main body 21 of the fixing member 2 is disposed so that it can be clamped (or inserted) between the first limit part 12 and the second limit part 13, so that a plate surface at one side of the plate-shaped main body 21 (a side close to the center of the air guide ring body 11) abuts against the first limit surface 123 of the first limit part 12 for limiting, and a plate surface at the other side of the plate-shaped main body 21 (a side away from the center of the air guide ring body 11) abuts against the second limit surface 131 of the second limit part 13 for limiting. The plate surface at one side of the plate-shaped main body 21 can be in direct contact with the first limit surface 123 and they can be in surface contact with each other. The plate surface at the other side of the plate-shaped main body 21 can be in direct contact with the second limit surface 131 and they can be in surface contact with each other. The surface contact increases a contact area between the fixing member 2 and the air guide ring body 11, and enhances the limiting effect on the air guide ring body 11. Alternatively, there may be line contact between the plate surface at one side of the plate-shaped main body 21 and the first limit surface, and line contact between the plate surface at the other side of the plate-shaped main body 21 and the second limit surface.

In some exemplary embodiments, as shown in FIGS. 2-5, the fixing member 2 is provided to further include a bending edge 22 formed by bending one end (upper end) of the plate-shaped main body 21. The bending edge 22 is provided to be bent toward a side where the center of the air guide ring 1 is located, and an included angle between the bending edge 22 and the plate-shaped main body 21 may be about 90 degrees, and the bending edge 22 may be used to support the air guide ring 1. The support part 17 of the air guide ring 1 is provided to be supported on the bending edge 22, so as to support and position the air guide ring 1 and the fixing member 2.

The bending edge 22 is provided with an avoidance recess 221, which can be used for avoidance on the one hand, and facilitate bending and forming the bending edge 22 on the other hand.

In some exemplary embodiments, as shown in FIGS. 2-5, the fixing member 2 is provided to further include a fixation lug 23 formed by bending the bending edge 22. The fixation lug 23 is provided to be bent toward a side (i.e. the upper side) away from the plate-shaped main body 21, and an included angle between the fixation lug 23 and the bending edge 22 may be about 90 degrees.

The fixation lug 23 can be used for fixation with the air guide ring 1, and the fixation lug 23 can be provided with a threaded hole. When fixing, the fixation lug 23 can extend into the air guide ring body 11 from a side where the air inlet is located, and a screw can be screwed with the threaded hole on the fixation lug 23 after passing through the screw fixing hole 18 on the air guide ring body 11, so as to implement the fixed connection between the air guide ring 1 and the fixing member 2.

A plurality (e.g. two) of fixation lugs 23 may be provided for securely fixing the air guide ring 1 and the fixing member 2 by a plurality of screws.

In some exemplary embodiments, the air guide ring 1 is a plastic member, and the fixing member 2 is a sheet metal member. The fixing member 2 has strong structural strength and is not prone to deformation, so the air guide ring 1 can be limited by the fixing member 2 to prevent the air guide ring 1 from deforming.

Apparently, materials of the air guide ring 1 and the fixing member 2 are not limited to the above, and can be adjusted according to actual needs.

In some exemplary embodiments, the fixing member 2 is provided as a motor beam for fixing a motor, i.e. the motor beam may be used for fixing both the motor and the air guide ring 1, thus having dual functions.

Selecting the motor beam for fixing the motor as the fixing member 2 for fixing and limiting the air guide ring 1 is conducive to reducing the number of components of the air conditioner outdoor unit, simplifying the structure of the product and reducing the cost.

Apparently, the fixing member 2 can also be separately provided for fixing the air guide ring 1.

In some exemplary embodiments, two fixing members 2 are provided. The motor beam may include a front motor beam at the front side and a rear motor beam at the rear side. The two fixing members 2 can be a front motor beam and a rear motor beam, respectively. Each of the front motor beam and the rear motor beam is provided with a bending edge 22. When the front motor beam and the rear motor beam are installed in place, the connecting seat 111 of the air guide ring 1 is placed on the bending edges 22 and positioned by the limit holes and the limit protrusions. At this time, the air guide ring body 11 is between the front motor beam and the rear motor beam, and the front and rear bulge parts 1132 (second limit parts 13) of the air guide ring body 11 respectively clamp the front motor beam and the rear motor beam from the front and rear sides. Finally, the air guide ring body 11 is fixed with the front motor beam by screws and the air guide ring body 11 is fixed with the rear motor beam by screws.

In contrast to some cases, in which the air guide ring 1 is supported on the bending edge 22 of the motor beam and fixed on the bending edge 22 of the motor beam by vertically arranged screws (arranged along the axial direction of the air guide ring 1), in the embodiment of the present application, the air guide ring 1 is supported on the bending edge 22 of the motor beam, and the first limit part 12 and the second limit part 13 are clamped on the two sides of the plate-shaped main body 21 of the motor beam, and the air guide ring 1 is fixed with the fixation lugs 23 of the motor beam by transversely arranged screws. In the embodiment of the present application, the motor beam can better fix and limit the air guide ring 1, so that the air guide ring 1 is firmly fixed and the deformation of the air guide ring 1 is prevented.

In the embodiment of the application, the first limit part 12 and the second limit part 13 are additionally provided for limit fitting with the motor beam, which can resist the deformation of the air guide ring body 11, improve the stress condition at fixing screws, improve a force transmission mode and a force conduction path of the air guide ring 1, reduce the deformation amount of the air guide ring 1 after being stressed, and is conducive to maintaining the structural stability of the air guide ring 1, thereby maintaining the installation gap between the air guide ring 1 and the fan blades, so that the air conditioner outdoor unit can maintain efficient and stable operation.

In some exemplary embodiments, the notch 14 is disposed close to a short side of the air conditioner outdoor unit.

An axis of the air guide ring 1 is arranged vertically, and the air inlet can face downward and the air outlet can face upward, so that the outdoor unit can achieve downward air inlet and upward air outlet. The arrangement of the notch 14 is conducive to reducing the volume of the air guide ring 1. The notch 14 is arranged close to a short side of a casing of the outdoor unit (for example, a shorter one of the sides of the casing along the front-rear direction and along the left-right direction, for example, the side along the front-back direction), so that the size of the air guide ring 1 can be enlarged as much as possible in the limited space in the casing, and the size of the air wheel can be maximized, thus benefiting the performance of the fan system, improving the air intake volume of the fan and reducing the working noise.

An embodiment of the present application further provides an air conditioner, which includes the air conditioner outdoor unit described in any of the above embodiments.

An embodiment of the present application further provides an air guide ring (or flow guide ring) 100', as shown in FIGS. 7-10, including an inlet section 1', a middle section 2' and an outlet section 3' arranged in sequence along a flowing direction of an airflow.

The air guide ring 100' can guide the airflow, make the flowing direction of the airflow regular, and reduce energy loss of airflow. The air guide ring body of the air guide ring 100' may include the inlet section 1', the middle section 2' and the outlet section 3' arranged in sequence along the flowing direction of the airflow. The airflow flows along the axial direction of the air guide ring 100'. Therefore, the inlet section 1', the middle section 2' and the outlet section 3' are arranged in sequence along the axial direction of the air guide ring 100'. The airflow can flow into an air inlet end 101' of the air guide ring 100'. The airflow first flows through the inlet section 1', then passes through the middle section 2' and the outlet section 3' in sequence, and finally flows out of an air outlet end 102' of the air guide ring 100', so that a direction from the inlet section 1' to the outlet section 3' is the flowing direction of the airflow.

In the air guide ring 100', the inlet section 1' includes two sub-inlet sections 1' connected in sequence, i.e., a first sub-inlet section 11' and a second sub-inlet section 12'. The first sub-inlet section 11' is close to the air inlet end 101' of the air guide ring 100', and the second sub-inlet section 12' is close to the middle section 2', so that the airflow flows first through the first sub-inlet section 11' and then through the second sub-inlet section 12' when flowing into the air guide ring 100'.

Figure 10:
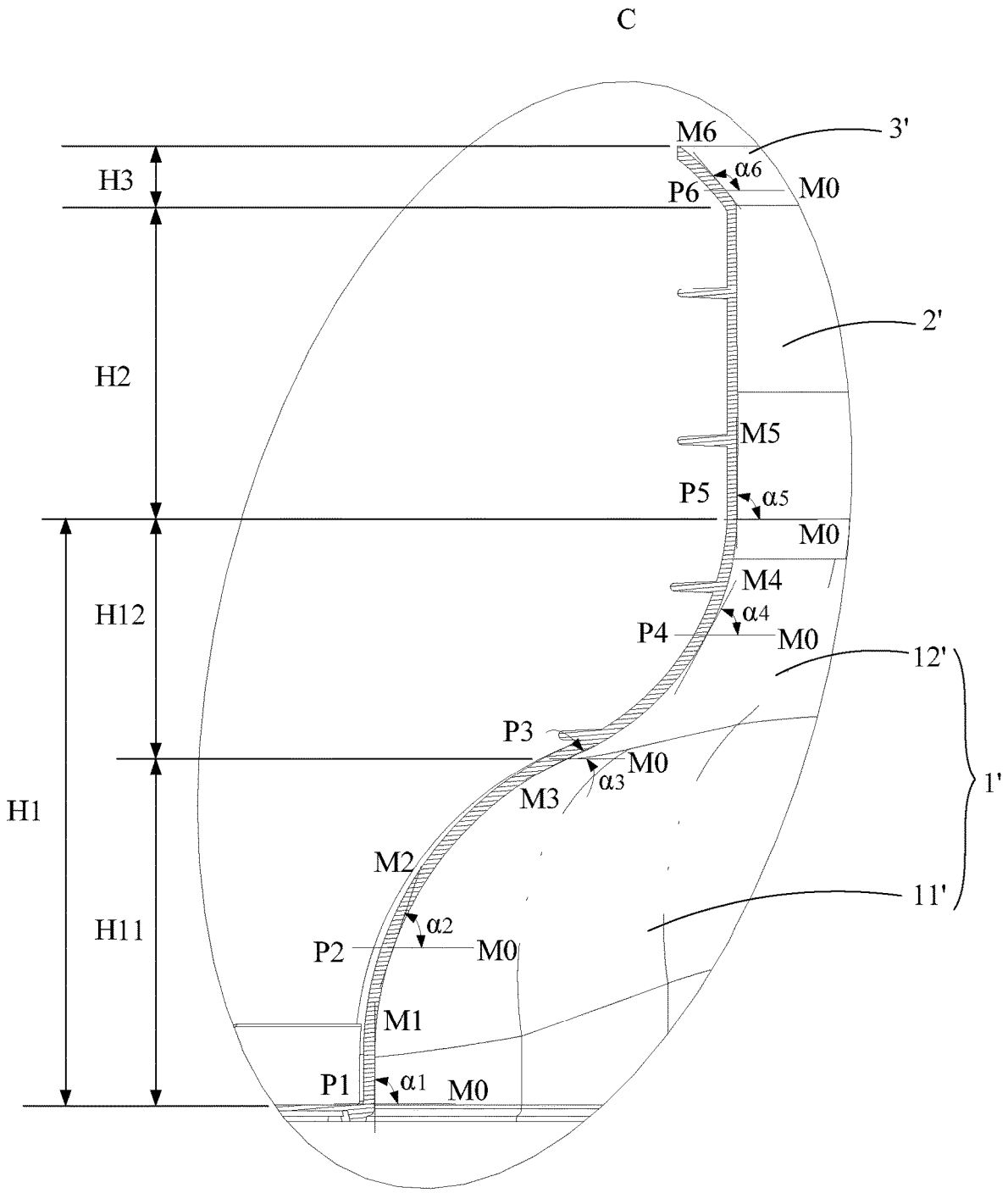
FIG. 10 is an enlarged schematic view of a structure of portion C in FIG. 9.

As shown in FIG. 10, the first sub-inlet section 11' includes a first inlet end close to the air inlet end 101' and a first outlet end away from the air inlet end 101', and the second sub-inlet section 12' includes a second inlet end close to the air inlet end 101' and a second outlet end away from the air inlet end 101'. The second inlet end of the second sub-inlet section 12' is smoothly transitioned to and connected with the first outlet end of the first sub-inlet section 11'. The first outlet end of the first sub-inlet section 11' is smoothly transitioned to and connected with the second inlet end of the second sub-inlet section 12', so that an inner wall surface of the first sub-inlet section 11' is smoothly transitioned to and connected with an inner wall surface of the second sub-inlet section 12', and the flow of airflow is unhindered and stable, so as to avoid turbulence when the airflow flows through a connecting portion between the first sub-inlet section 11' and the second sub-inlet section 12', which causes greater energy loss of the airflow, affecting the guiding effect of the air guide ring 100' and increasing noise.

As shown in FIG. 10, the inner wall surface of the first sub-inlet section 11' is a concave surface recessed toward the outside of the air guide ring 100', and a tangent plane of the concave surface is produced through a point on the concave surface, and there is an included angle between the tangent plane and a first plane M0 (perpendicular to the axis of the air guide ring 100'). Included angles between different points on the inner wall surface of the first sub-inlet section 11' and the first plane M0 are gradually reduced along the flowing direction of the airflow. As shown in FIG. 10, the inner wall surface of the first sub-inlet section 11' has three points P1, P2 and P3 arranged in sequence along the flowing direction of the airflow, where P1 is at the first inlet end of the first sub-inlet section 11', P3 is a point on an intersection line between the inner wall surface of the first outlet end of the first sub-inlet section 11' and the inner wall surface of the second inlet end of the second sub-inlet section 12', and P2 is between P1 and P3. Included angles between the tangent planes M1, M2 and M3 at the three points P1, P2 and P3 and the first plane M0 are $\alpha 1$, $\alpha 2$ and $\alpha 3$, respectively, and $\alpha 1>\alpha 2>\alpha 3$.

The first sub-inlet section 11' is constructed along the flowing direction of the airflow, and the included angles between the tangent planes at different points on the inner wall surface of the first sub-inlet section 11' and the first plane M0 gradually reduce, so that a ventilation cross-sectional area of the first sub-inlet section 11' is gradually reduced along the flowing direction of the airflow, that is, the first sub-inlet section 11' is gradually contracted, and a flow velocity can be increased when the airflow flows through the first sub-inlet section 11', which is conducive to improving the air intake volume of the air guide ring 100'.

As shown in FIG. 10, the inner wall surface of the second sub-inlet section 12' is a convex surface protruding toward the inside of the air guide ring 100', and a tangent plane of the convex surface is produced through a point on the convex surface, and there is an included angle between the tangent plane and the first plane (perpendicular to the axis of the air guide ring 100'). The included angles between the different points on the inner wall surface of the second sub-inlet section 12' and the first plane M0 gradually increase along the flowing direction of the airflow. As shown in FIG. 10, the inner wall surface of the second sub-inlet section 12' is provided with three points P3, P4 and P5 arranged in sequence along the flowing direction of the airflow, where P3 is a point on the intersection line between the inner wall surface of the first outlet end of the first sub-inlet section 11' and the inner wall surface of the second inlet end of the second sub-inlet section 12', P5 is at the second outlet end of the second sub-inlet section 12', and P4 is between P3 and P5. The included angles between the tangent planes M3, M4 and M5 at the three points P3, P4 and P5 and the first plane M0 are $\alpha 3$, $\alpha 4$ and $\alpha 5$, respectively, and $\alpha 3<\alpha 4<\alpha 5$.

The second sub-inlet section 12' is constructed along the flowing direction of the airflow, and included angles between the tangent planes at different points on the inner wall surface of the second sub-inlet section 12' and the first plane M0 gradually increase, so that the inner wall surface of the second sub-inlet section 12' forms a convex surface protruding toward the inside of the air guide ring 100', and a ventilation cross-sectional area of the second sub-inlet section 12' can be further reduced, which is conducive to further improving the airflow velocity and the air intake volume.

Compared with the sub-inlet section 1' of which the inner wall surface is a conical surface, by providing the first sub-inlet section 11' of which the inner wall surface is a concave surface and the second sub-inlet section 12' of which the inner wall surface is a convex surface, so that the inlet section 1' has better guiding effect on the airflow and improves the air intake volume, and the airflow will smoothly flow along the inner wall surface of the inlet section 1' after entering the inlet section 1', without rebounding after colliding with the inner wall surface of the inlet section 1' to reduce the energy of the airflow, generating turbulence, noise, etc., the stability of the gas flow is relatively high, and the noise generated when the airflow flows through the air guide ring 100' can be effectively reduced.

Therefore, by providing the first sub-inlet section 11' and the second sub-inlet section 12' in the air guide ring 100' according to the embodiment of the present application, the air intake volume of the air guide ring 100' can be increased and the noise of the airflow can be reduced.

In some exemplary embodiments, as shown in FIG. 10, the concave surface of the inner wall surface of the first sub-inlet section 11' is a concave spherical surface, and the convex surface of the inner wall surface of the second sub-inlet section 12' is a convex spherical surface.

It should be understood that the concave surface of the inner wall surface of the first sub-inlet section 11' and the convex surface of the inner wall surface of the second sub-inlet section 12' may also be surfaces of other shapes except the spherical surfaces.

In some exemplary embodiments, as shown in FIG. 10, in the first sub-inlet section 11', the included angle $\alpha 1$ between the tangent plane of the inner wall surface of the first inlet end and the first plane M0 is 70° to 90°. For example, $\alpha 1$ may be 70°, 73°, 75°, 78°, 80°, 83°, 85°, 87°, 90°, etc. In the first sub-inlet section 11', the included angle $\alpha 3$ between the tangent plane of the inner wall surface of the first outlet end and the first plane is 35° to 55°, for example, $\alpha 3$ can be 35°, 38°, 40°, 42°, 45°, 48°, 50°, 52°, 55°, etc.

The included angle $\alpha 1$ between the tangent plane M1 at the point P1 on the inner wall surface of the first inlet end and the first plane M0 is 70° to 90°. The included angle $\alpha 3$ between the tangent plane M3 at the point P3 on the inner wall surface of the first outlet end and the first plane M0 is 35° to 55°. Along a direction from the first inlet end towards the first outlet end, i.e. along the flowing direction of the airflow, the included angles between tangent planes at different points on the inner wall surface of the first sub-inlet section 11' and the first plane are between $\alpha 1$ and $\alpha 3$. For example, the included angle $\alpha 2$ between the tangent plane M2 at point P2 on the inner wall surface of the first sub-inlet section 11' and the first plane M0 is between a1 and a3, i.e. $\alpha 1>\alpha 2>\alpha 3$.

When the air guide ring 100' is applied to a product (such as an air conditioner outdoor unit), the inner wall surface of the first inlet end of the first sub-inlet section 11' of the air guide ring 100' is not as regular as a circle because of limitation of the structural size of the outdoor unit. Therefore, the included angles between the first plane M0 and tangent planes at a plurality of points on the inner wall surface of the first inlet end of the first sub-inlet section 11' arranged along the circumferential direction of the air guide ring 100' may be different, for example, 80°, 82°, 78°, etc., respectively. However, along the flowing direction of the airflow, an overall change trend of the included angle between a tangent plane of the inner wall surface of the first sub-inlet section 11' and the first plane M0 is decreasing, and an overall change trend of the included angle between a tangent plane of the inner wall surface of the second sub-inlet section 12' and the first plane M0 is increasing, which is solely changing from an angle to another angle, and this angle is not fixed, but varies within a certain range.

It should be understood that a value range of the included angle $\alpha 1$ is not limited to 80°-90°, and can be adjusted according to actual needs. A value range of included angle $\alpha 3$ is not limited to 35°-55°, but can also be adjusted according to actual needs.

In some exemplary embodiments, as shown in FIG. 10, in the second sub-inlet section 12', an included angle between a tangent plane of the inner wall surface of the second inlet end and the first plane M0 is equal to the included angle $\alpha 3$ between a tangent plane of the inner wall surface of the first outlet end and the first plane M0, and the included angle $\alpha 5$ between a tangent plane of the inner wall surface of the second outlet end and the first plane M0 is 80°-100°.

Since the second inlet end of the second sub-inlet section 12' is smoothly transitioned to and connected with the first outlet end of the first sub-inlet section 11', the included angle between the tangent plane of the inner wall surface of the second inlet end of the second sub-inlet section 12' and the first plane is equal to the included angle between the tangent plane of the inner wall surface of the first outlet end and the first plane. As shown in the FIG. 10, the point P3 is the point on the intersection line between the inner wall surface of the first outlet end of the first sub-inlet section 11' and the inner wall surface of the second inlet end of the second sub-inlet section 12', and the tangent plane of the inner wall surface of the first sub-inlet section 11' produced through the point P3 coincides with the tangent plane of the inner wall surface of the second sub-inlet section 12' produced through the point P3, both of which are tangent planes M3. Therefore, the included angle between the tangent plane of the inner wall surface of the second inlet end of the second sub-inlet section 12' and the first plane is equal to the included angle between the tangent plane of the inner wall surface of the first outlet end and the first plane, both of which are a3, and a3 is 35°-55°.

The included angle $\alpha 5$ between the tangent plane M5 at the point P5 on the inner wall surface of the second outlet end and the first plane M0 is 80°-100°, for example, $\alpha 5$ can be 80°, 83°, 85°, 88°, 90°, 93°, 95°, 97°, 100°, etc. When the included angle $\alpha 5$ is 80°-90°, the ventilation cross-sectional area of the second sub-inlet section 12' decreases gradually, and when the included angle $\alpha 5$ is 90°-100°, the ventilation cross-sectional area of the second sub-inlet section 12' first decreases gradually and then increases gradually.

Along a direction from the second inlet end of the second sub-inlet section 12' towards the second outlet end, i.e. along the flowing direction of the airflow, the included angles between the tangent planes at different points on the inner wall surface of the second sub-inlet section 12' and the first plane are between $\alpha 3$ and $\alpha 5$. For example, the included angle $\alpha 4$ between the tangent plane M4 at the point P4 on the inner wall surface of the second sub-inlet section 12' and the first plane M0 is between $\alpha 3$ and $\alpha 5$, i.e., $\alpha 3<\alpha 4<\alpha 5$.

It should be understood that the value range of the included angle $\alpha 5$ is not limited to 80°-100°, and can be adjusted according to actual needs.

In some exemplary embodiments, as shown in FIG. 10, a ventilation cross-sectional area of the middle section 2' of the air guide ring 100' remains unchanged.

An inner wall surface of the middle section 2' may be a cylindrical surface so that the ventilation cross-sectional area of the middle section 2' remains unchanged. An axis of the cylindrical surface coincides with the axis of the air guide ring 100', and the included angle $\alpha 5$ between the tangent plane at point P5 on the inner wall surface of the second outlet end of the second sub-inlet section 12' and the first plane is 90°, so as to achieve a smooth transition and connection between the inner wall surface of the second outlet end of the second sub-inlet section 12' and the inner wall surface of the middle section 2'.

In some exemplary embodiments, as shown in FIG. 10, a ventilation cross-sectional area of the outlet section 3' of the air guide ring 100' gradually increases.

Along the flowing direction of air, the ventilation cross-sectional area of the outlet section 3' increases gradually, so as to enlarge an air exit range of the air guide ring 100', reduce the airflow velocity and reduce the noise.

In some exemplary embodiments, an included angle $\alpha 6$ between a tangent plane of an inner wall surface of the outlet section 3' and the first plane perpendicular to the axis of the air guide ring 100' is 95°-180°.

As shown in FIG. 10, the included angle $\alpha 6$ between the tangent plane M6 at any point P6 on the inner wall surface of the outlet section 3' and the first plane M0 is 95°-180°. For example, $\alpha 6$ may be 95°, 100°, 110°, 120°, 130°, 140°, 150°, 160°, 170°, 180°, etc.

The inner wall surface of the outlet section 3' can be a convex spherical surface protruding toward the inside of the air guide ring 100', and along the flowing direction of the airflow, included angles between tangent planes of the inner wall surface of the outlet section 3' and the first plane perpendicular to the axis of the air guide ring 100' gradually increase, that is, a plurality of different points are arranged in sequence along the flowing direction of the airflow on the inner wall surface of the outlet section 3', and included angles between tangent planes at the plurality of different points and the first plane M0 gradually increase.

It should be understood that a value range of the included angle $\alpha 6$ is not limited to 95°-180°, but can also be adjusted according to actual needs. The inner wall surface of the outlet section 3' is not limited to a convex spherical surface protruding toward the inside of the air guide ring 100', but may also be a conical surface or the like.

In some exemplary embodiments, a relationship among a height H1 of the inlet section 1', a height H2 of the middle section 2', and a height H3 of the outlet section 3' along the axial direction of the air guide ring 100' is $0.5H2 \le H1 \le 1.5H2$, $0.05H2 \le H3 \le 1.5H2$.

As shown in FIG. 10, along the axial direction of the air guide ring 100', a height of the first sub-inlet section 11' is H11, a height of the second sub-inlet section 12' is H12, where H11 may be greater than, less than or equal to H12. The height of the inlet section 1' is H1, and H1=H11+H12. Along the axial direction of the air guide ring 100', the height of the middle section 2' is H2, and the height of the outlet section 3' is H3. The relationship among H1, H2 and H3 is $0.5H2 \le H1 \le 1.5H2$, $0.05H2 \le H3 \le 1.5H2$.

H1, H2 and H3 meet the above relationship, and combined with shapes of the inner wall surfaces of the inlet section 1', the middle section 2' and the outlet section 3', the air guide ring 100' has a good flow guiding effect, stable airflow, and can effectively reduce the energy loss and working noise when the airflow flows in the air guide ring 100'.

A certain relationship is satisfied between the height H1 of the inlet section 1' and the height H2 of the middle section 2', and a certain relationship is satisfied between the height H3 of the outlet section 3' and the height H2 of the middle section 2'. Therefore, after the height H2 of the middle section 2' is determined, the height H1 of the inlet section 1' and the height H3 of the outlet section 3' can be determined according to the height H2 of the middle section 2', so as to realize the design of the axial height of the air guide ring 100'.

It should be understood that the relationship among H1, H2 and H3 is not limited to the above and can be adjusted according to actual needs.

In some exemplary embodiments, along the axis of the air guide ring 100', a relationship between the height H2 of the middle section 2' and an axial height H0 of the fan blades extending into the air guide ring 100' is $0.3H0 \le H2 \le 1.2H0$.

When the air guide ring 100' is used in conjunction with the fan, the fan blades of the fan can extend to the middle section 2' of the air guide ring 100', and the axis of the middle section 2' coincides with an axis of the fan blades. Along the axial direction of the air guide ring 100', the height of the middle section 2' is H2, and an axial height of the fan blades is H0. The relationship between H2 and H0 is $0.3H0 \le H2 \le 1.2H0$. In this way, the height H2 of the middle section 2' can be determined according to the axial height H0 of the fan blades, and then the height H1 of the inlet section 1' and the height H3 of the outlet section 3' can be determined according to the height H2 of the middle section 2', so that the size of the air guide ring 100' matches a size of the fan blades, so that the air guide ring 100' can achieve good flow guiding effect when the fan works and drives air to flow.

It should be understood that the relationship between H0 and H2 is not limited to the above and can be adjusted according to actual needs.

Figure 11:
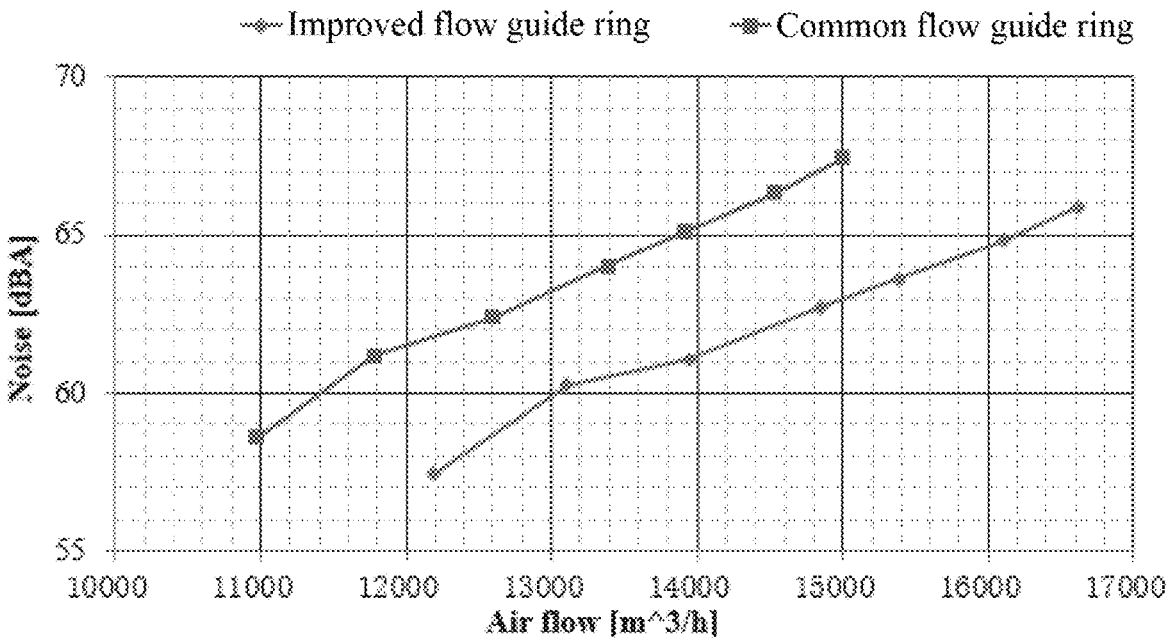
FIG. 11 is a comparison diagram of air volume noise test data and noise spectrum of an air guide ring according to an embodiment of the present application.
Figure 12A:
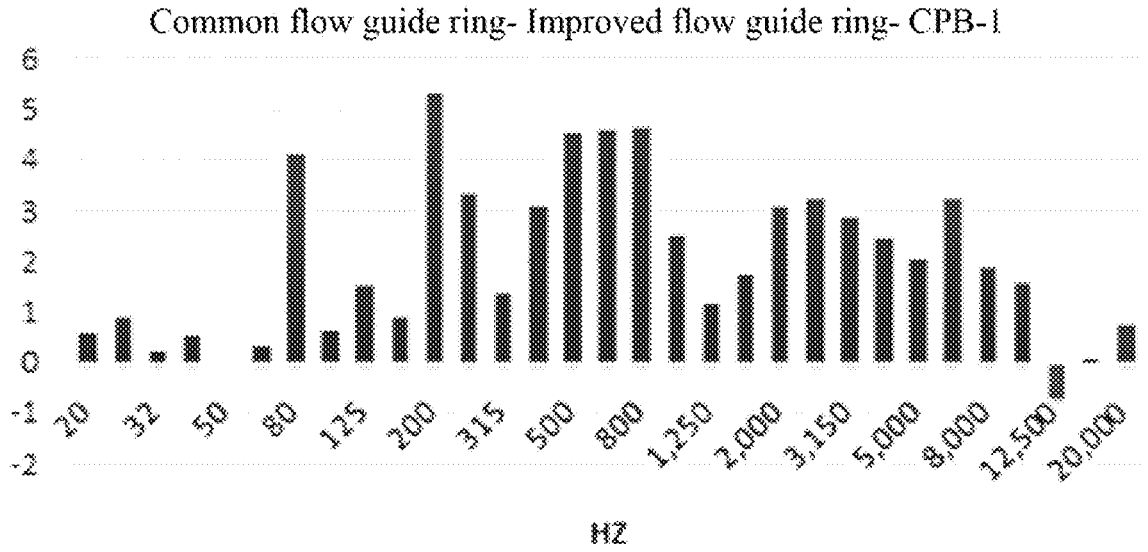
FIG. 12A is a schematic diagram of a constant percentage bandwidth (CPB) of a noise spectrum of an air guide ring according to an embodiment of the present application.
Figure 12B:
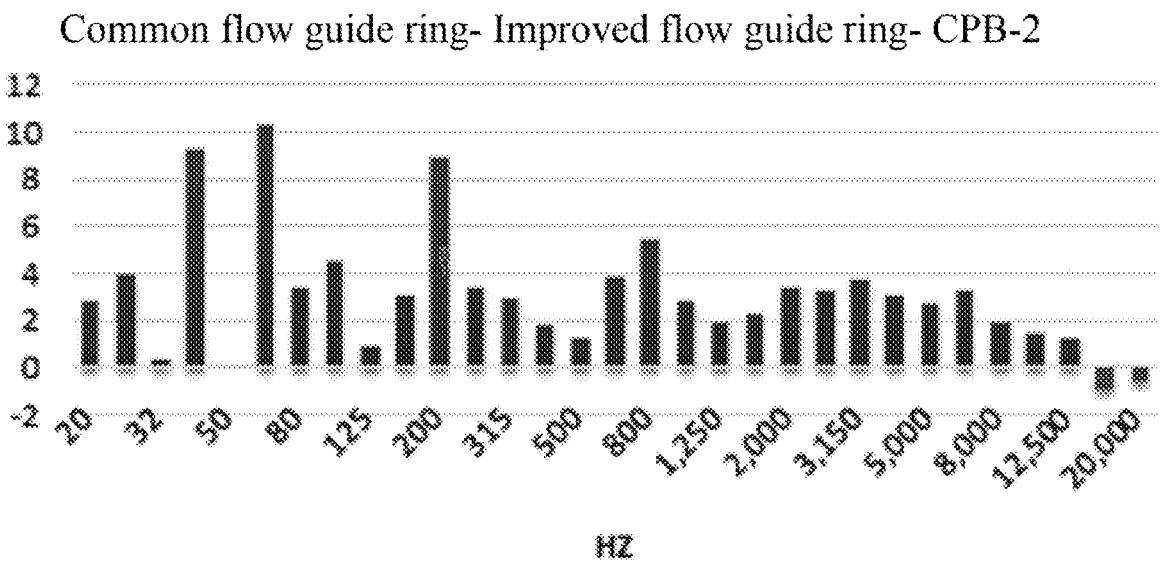
FIG. 12B is a schematic diagram of another constant percentage bandwidth (CPB) of a noise spectrum of an air guide ring according to an embodiment of the present application.
Figure 12C:
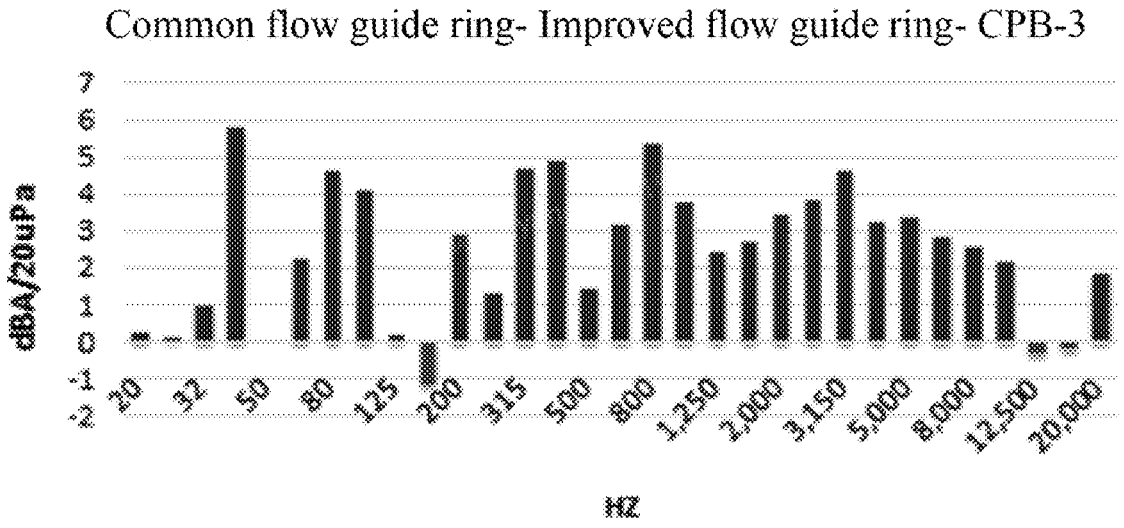
FIG. 12C is a schematic diagram of yet another constant percentage bandwidth (CPB) of a noise spectrum of an air guide ring according to an embodiment of the present application.
Figure 12D:
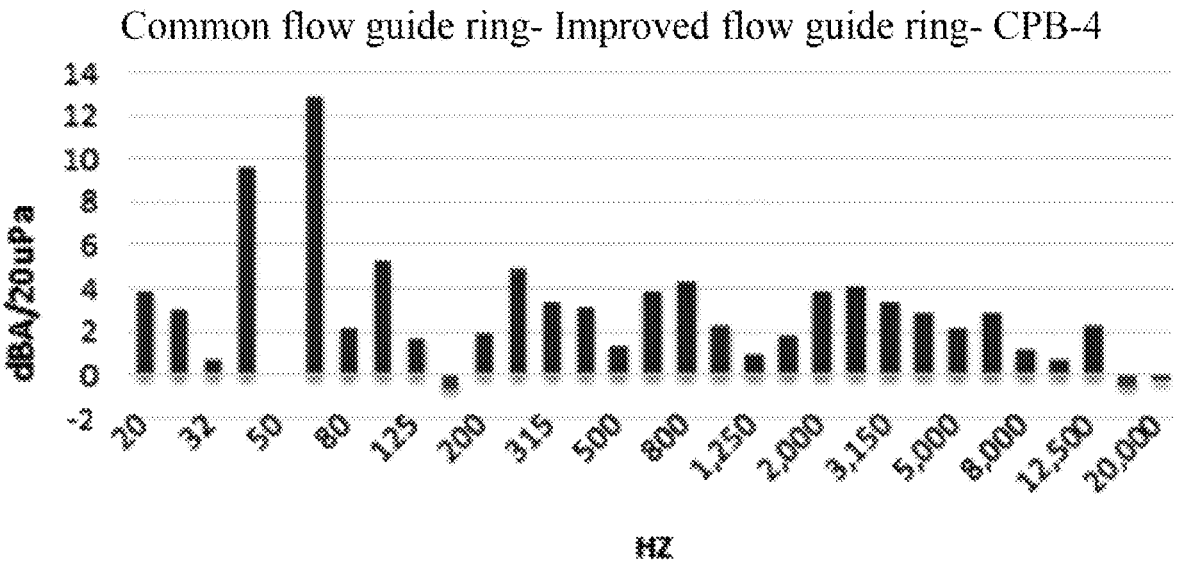
FIG. 12D is a schematic diagram of still yet another constant percentage bandwidth (CPB) of a noise spectrum of an air guide ring according to an embodiment of the present application.

The air guide ring 100' according to the embodiment of the present application is compared with a common air guide ring, and the results are shown in FIGS. 11-12*d*.

As shown in FIG. 11, FIG. 11 is a comparison diagram of air volume noise test data and noise spectrum between the air guide ring (improved air guide ring) 100' according to the embodiment of the present application and the common air guide ring under same working conditions. When an air volume of the air guide ring 100' according to the embodiment of the present application and an air volume of the common air guide ring are both 14000 $m^3/h$, the air guide ring 100' according to the embodiment of the present application can reduce the noise by about 4 dBA compared with the common air guide ring. As shown in FIGS. 12A-12D, FIGS. 12A-12D are schematic diagrams of constant percentage bandwidth (CPB) of the noise spectrum of four sides of the air guide ring 100' at frequencies of 20 Hz-20000 Hz, respectively, with the abscissa as the frequencies and the ordinate as a difference between a noise value of the common air guide and a noise value of the air guide ring (improved air guide ring) 100' according to the embodiment of the present application. As can be seen from FIGS. 12A-12D, in a frequency range of 20 Hz-20000 Hz, the difference value of the noise value of the common air guide ring minus the noise value of the air guide ring 100' according to the embodiment of the present application is mostly positive, that is, the noise value of the air guide ring 100' of the present application is smaller than the noise value of the common air guide ring. It can be seen that the noise performance of the air guide ring 100' according to the embodiment of the present application is obviously superior to that of the common air guide ring.

Through experiments, it can be seen that, under a condition that the air guide ring 100' of the present application has a same rotating speed as the fan blades in the common air guide ring, a ventilation volume is increased by 8%-11% and the noise can be reduced by 0.8 dBA-1.5 dBA by adopting the air guide ring 100' of the present application. Under a condition of the same ventilation volume, the working noise can be reduced by 3 dBA-4 dBA on average by adopting the air guide ring 100' according to the embodiment of the present application.

An embodiment of the present application further provides an air conditioner outdoor unit, which includes the air guide ring 100' provided by any of the above embodiments.

An embodiment of the present application further provides an air conditioner, which includes the air conditioner outdoor unit described above.

In the description herein, it should be noted that the terms "one side", "the other side", "one end", "the other end", "side", "opposite" and the like denote an orientation or positional relationship based on those shown in the drawings and are intended for ease of description and simplification only, and are not intended to indicate or imply that the structure referred has a particular orientation, is constructed and operates in a particular orientation, and therefore cannot be construed as limiting on the present application.

In the description herein, it should be noted that the term "a plurality of" refers to two or more.

In the description of the embodiments of the present application, unless otherwise specified and limited, the terms "connection", "fixation", "mounting" and the like should be understood in a broad sense, for example, the "connection" may be fixed connection, detachable connection or integrated connection; it may be direct connection, or indirect connection through an intermediary, or may be an internal communication between two elements. Specific meanings of the above terms herein may be understood by those of ordinary skills in the art according to a specific situation.

Although implementations disclosed herein are described above, the described contents are only implementations used for facilitating understanding of the present application, and are not intended to limit the present application. Without departing from the spirit and scope disclosed herein, any person skilled in the art to which the present application pertains may make any modification and change in the form and details of implementation, but the scope of patent protection of the present application shall still be defined by the appended claims.

What is claimed is:

1. An air guide ring, for an air conditioner outdoor unit, the air guide ring comprising:

an air guide ring body, an air guide channel being defined in the air guide ring body, wherein the air guide ring body comprises a first limit part and a second limit part, wherein the first limit part and the second limit part are provided to be fitted with a fixing member of the air conditioner outdoor unit for bidirectional limiting, so as to prevent inward contracting deformation and outward expanding deformation of the air guide ring body, wherein the air guide ring body comprises a connecting seat with a first air guide channel and an air guide tube with a second air guide channel, a first end of the connecting seat is connected with the air guide tube, the first air guide channel and the second air guide channel are communicated to define the air guide channel, and a second end of the connecting seat defines an air inlet of the air guide channel, wherein the connecting seat comprises two limit sidewalls oppositely disposed, each of the limit sidewalls comprises the first limit part and the second limit part arranged at intervals along a radial direction of the air guide ring body, and a radial interval between the first limit part and the second limit part of each of the limit sidewalls is provided for clamping the fixing member, and wherein each limit sidewall comprises a body portion and a bulge part protruding outward from the body portion, the body portion of the limit sidewall forms the first limit part, the bulge part forms the second limit part, and a limit incision formed between the body portion and the bulge part is provided for clamping the fixing member.

2. The air guide ring according to claim 1, wherein the second limit part is at a side of the first limit part away from a center of the air guide ring body and the first limit part and the second limit part are provided to be clamped at two sides of the fixing member.

3. The air guide ring according to claim 2, wherein the first limit part and the second limit part are provided to be offset or distributed along the air guide ring body in a circumferential direction.

4. The air guide ring according to claim 2, wherein the first limit part comprises a first sub-limit part and a second sub-limit part, and the first sub-limit part, the second limit part and the second sub-limit part are arranged in sequence along the air guide ring body in a circumferential direction.

5. The air guide ring according to claim 4, wherein a notch is provided at a side of the air guide ring body close to an air inlet of the air guide channel, the first sub-limit part and the second sub-limit part are respectively at two sides of the notch, and the second limit part is a bulge part extending toward the notch along the axial direction of the air guide ring body.

6. The air guide ring according to claim 5, wherein a reinforcing rib is provided on a side wall surface at a side of the bulge part away from the center of the air guide ring body.

7. The air guide ring according to claim 1, wherein a plurality of first limit parts and a plurality of second limit parts are provided, and both the plurality of first limit parts and the plurality of second limit parts are arranged along the air guide ring body in a circumferential direction, a quantity of the first limit parts is equal to a quantity of the second limit parts, and the first limit parts and the second limit parts are fitted in one-to-one correspondence for bidirectional limiting.

8. The air guide ring according to claim 1, wherein the air guide ring body is provided with a support part extending along a circumferential direction, the support part is provided to be supported on the fixing member, and the first limit part and the second limit part are at a side of the support part close to an air inlet of the air guide channel.

9. The air guide ring according to claim 8, wherein a side wall of the air guide ring body is provided with a fixation part at a side of the support part close to an air outlet of the air guide channel, and the fixation part is provided to be fixedly connected with the fixing member.

10. The air guide ring according to claim 1, wherein the air guide ring body is provided with one of a limit protrusion and a limit hole, which is provided to be fitted with the other one of a limit protrusion and a limit hole on the fixing member for limiting.

11. An air conditioner outdoor unit, comprising:

the air guide ring according to claim 1; and the fixing member, wherein the fixing member is provided with a first limit fitting part and a second limit fitting part, the first limit fitting part is fitted with the first limit part of the air guide ring to obstruct the outward expanding deformation of the air guide ring body, and the second limit fitting part is fitted with the second limit part of the air guide ring to obstruct the inward contracting deformation of the air guide ring body.

12. The air conditioner outdoor unit according to claim 11, wherein the fixing member comprises a plate-shaped main body, two opposite plate surfaces of the plate-shaped main body form the first limit fitting part and the second limit fitting part, respectively, and the plate-shaped main body is clamped between the first limit part and the second limit part.

13. The air conditioner outdoor unit according to claim 12, wherein the fixing member further comprises a bending edge formed by bending one end of the plate-shaped main body toward a center of the air guide ring, and a support part of the air guide ring is supported on the bending edge.

14. The air conditioner outdoor unit according to claim 13, wherein the fixing member further comprises a fixation lug formed by bending the bending edge toward a side away from the plate-shaped main body, and the fixation lug extends into the air guide ring body and is fixed with a fixation part of the air guide ring by a screw.

15. The air conditioner outdoor unit according to claim 11, wherein the fixing member comprises a motor beam for fixing a motor.

16. An air conditioner, comprising the air conditioner outdoor unit according to claim 11.

17. An air guide ring, comprising an inlet section, a middle section and an outlet section arranged in sequence along a flowing direction of airflow, wherein the inlet section comprises a first sub-inlet section disposed close to an air inlet end of the air guide ring and a second sub-inlet section disposed close to the middle section, wherein an inner wall surface of the first sub-inlet section is a concave surface recessed toward outside of the air guide ring, and an inner wall surface of the second sub-inlet section is a convex surface protruding toward inside of the air guide ring, and along the flowing direction of airflow, an included angle between a tangent plane of the inner wall surface of the first sub-inlet section and a first plane perpendicular to an axis of the air guide ring gradually decreases, and an included angle between a tangent plane of the inner wall surface of the second sub-inlet section and the first plane gradually increases.

* * * * *